United States Patent [19]

Yoshinaga

[11] Patent Number: 4,541,707

[45] Date of Patent: Sep. 17, 1985

[54] RECORDING APPARATUS HAVING PARTING AGENT REMOVING MEANS

[75] Inventor: Kenji Yoshinaga, Yokohama, Japan

[73] Assignee: Canon Kabushiki Kaisha, Tokyo, Japan

[21] Appl. No.: 596,832

[22] Filed: Apr. 4, 1984

[30] Foreign Application Priority Data

Apr. 8, 1983 [JP] Japan ..... 52244

[51] Int. Cl.[4] ..... G03G 15/00

[52] U.S. Cl. ..... 355/3 FU; 355/3 R; 355/14 FU; 118/DIG. 1; 219/216

[58] Field of Search ..... 355/3 FU, 3 R, 14 FU, 355/10; 219/216; 118/DIG. 1, 203, 204, 643, 104

[56] References Cited

U.S. PATENT DOCUMENTS

| | | | |
|---|---|---|---|
| 3,820,891 | 6/1974 | Kurakawa et al. | 355/10 |
| 4,193,691 | 3/1980 | Tanigawa et al. | 355/3 FU |
| 4,231,653 | 11/1980 | Nagahara et al. | 355/3 FU |
| 4,285,295 | 8/1981 | Iwao et al. | 355/3 FU X |
| 4,332,457 | 6/1982 | Mitsuyama et al. | 355/3 FU |
| 4,393,804 | 7/1983 | Nygard et al. | 355/3 FU X |

*Primary Examiner*—A. C. Prescott

*Attorney, Agent, or Firm*—Fitzpatrick, Cella, Harper & Scinto

[57] ABSTRACT

This invention provides a recording apparatus having parting agent removing means. Fixing means for fixing a formed toner image on a recording medium has a fixing rotatable member for contacting the toner image side of the recording medium and means for applying offset preventing parting liquid to the rotatable member. Means for acting on a special recording medium inferior in parting liquid absorbing capability to paper and removing the parting liquid from the special recording medium is positioned downstream of the fixing rotatable member with respect to the direction of conveyance of the recording medium. Control means is provided for causing the removing means to act on the special recording medium. The parting liquid on the recording medium such as film can be greatly decreased by the removing means.

20 Claims, 12 Drawing Figures

RECORDING APPARATUS HAVING PARTING AGENT REMOVING MEANS

BACKGROUND OF THE INVENTION

1. Field of the Invention

This invention relates to a recording apparatus such as an electrophotographic apparatus or an electrostatic recording apparatus and specifically a copying apparatus, a printer or a facsimile apparatus, and more particularly to a recording apparatus provided with a mechanism for applying parting liquid as an offset preventing agent to a fixing rotatable member when toner in the form of dust, powder or capsule is fixed on a recording medium.

2. Description of the Prior Art

The recording apparatus to which the present invention pertains generally uses a fixing device in which a recording medium is passed between a pair of rollers as a pair of fixing rotatable members and a dust toner image is fixed on the recording medium by applying a pressure or heat and pressure to between the pair of rollers.

Such fixing device has many advantages as compared with conventional devices while, on the other hand, it has a fault. The fault is that the dust toner image directly contacts the fixing rollers and therefore the toner to be fixed on the recording medium such as low temperature offset or high temperature offset may adhere to the surfaces of the rollers. When the toner adheres to the surfaces of the rollers, it may affect the image on the next recording medium passing between the rollers and the toner may be fixed on unexpected parts of the recording medium or may stain the recording medium. To avoid occurrence of such problem, it is generally practised to apply a parting agent such as silicon oil to the surfaces of the rollers to thereby prevent offset.

The toner offset preventing method using the application of the parting agent may cause the following problem to arise depending on the material of the recording medium.

The parting agent applied onto the rollers, conversely to toner, adheres to the recording medium to a certain degree as the recording medium passes between the rollers, and where the recording medium is, for example, paper, the parting agent having adhered to the paper is absorbed into the paper and there arises no problem, but where the recording medium does not have such an absorbing capability, there arises a problem that the parting agent having adhered to the surface of the recording medium intactly stagnates on that surface. As a recording medium of such a material, mention may typically be made of a resin material such as trapen film used, for example, for OHP (overhead projector). Such stagnation of the parting agent on the surface of the recording medium makes the surface of the recording medium discharged from the fixing station wet with the parting agent and makes the sense of touch of the recording medium very bad. Particularly, in a color image copying apparatus or the like in which, for smoothing the mixing of three primary color toners during fixation, toners of low fusing point are used to provide better fluidity during heating for fixation, a relatively great amount of silicon oil is applied to the fixing rollers and therefore much silicon oil adheres to the recording medium and thus, the sense of dipleasure thereof is very remarkable. This problem is not limited to the sense of touch, but if the recording medium is kept in contact with other paper or the like for a long time, the parting agent may permeate into the paper and stain the paper and further, if recording mediums wet with the parting agent are superimpose one upon the other, the recording mediums may adhere to each other due to the parting agent and cannot be handled properly, and this may lead to cumbersomeness of the arrangement or treatment of the recording mediums, and may further lead to a problem that writing of characters or the like onto the recording medium by magic ink or a felt pen becomes impossible because the parting agent on the surface of the recording medium rejects such ink.

Particularly, if much of this parting agent adheres to the resin film for OHP, it may cause the parting agent to interfere with the transmitted light and may result in unsharp images.

Against such a problem, it has heretofore been practised to reduce the amount of parting agent applied to the fixing rollers, but a sufficient effect has not been obtained and especially in the case of resin film, this problem has not been solved at all.

The present invention provides a solution to such problem and achieves a novel and important effect.

SUMMARY OF THE INVENTION

It is an object of the present invention to solve the above-noted problem peculiar to the prior art and to provide a recording apparatus provided with means for removing parting liquid from a recording medium having a toner image fixed thereon.

It is another object of the present invention to provide a recording apparatus provided with a parting agent removing means provided with means for supplying to the parting liquid on the recording medium an auxiliary agent for weakening the adhesion of the parting liquid to the surface of the recording medium or the surface of the image to enhance the capability of removing the parting liquid on the recording medium.

It is still another object of the present invention to provide a recording apparatus in which the recording medium is a resin film and which has removing means for greatly decreasing the parting liquid on this film. Particularly, it is an object of the present invention to provide a recording apparatus in which the inconvenience by the parting liquid when a color image is formed on the resin film can be greatly decreased.

Other objects of the present invention will become apparent from the following description taken in conjunction with the accompanying drawings.

DESCRIPTION OF THE PERFERRED EMBODIMENTS

Figure 1:
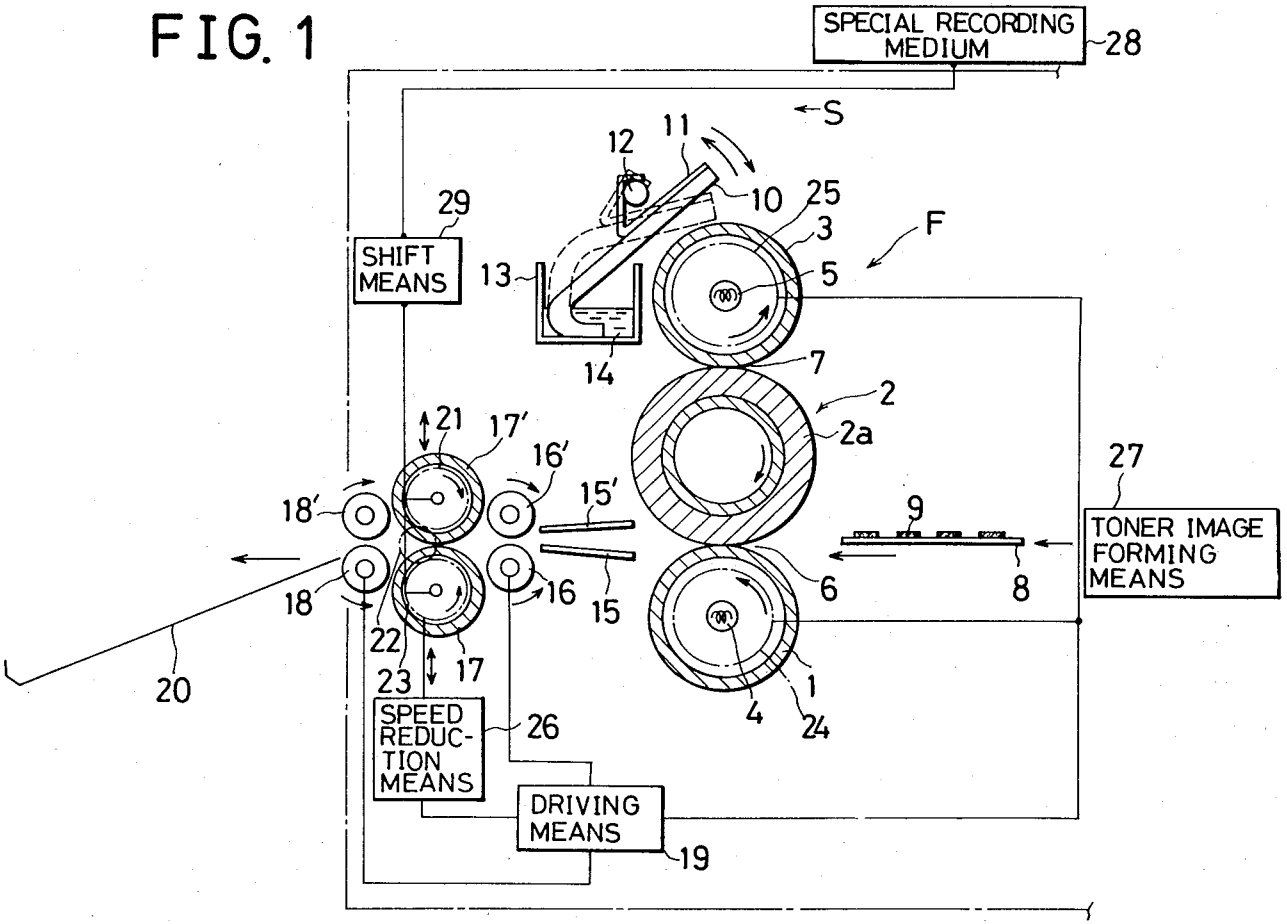
FIG. 1 illustrates the essential portions of an embodiment of the present invention.

Referring to FIG. 1 which shows the structural portions of a fixing device for fixing a visualized unfixed toner image formed on a recording medium by conventional toner image forming means in an image forming apparatus and a parting agent wiping device subsequent thereto, reference numerals 1 and 3 designate fixing rollers having their surfaces coated with tetrafluoroethylene resin to provide a good parting property with respect to toner, and a fixing roller 2 disposed between and rotated in contact with the fixing rollers 1 and 3 is constructed so as to have a soft surface layer *2a* of silicon rubber. The rollers 1 and 3 are hollow and have heaters 4 and 5 inserted therein and are suitably heated by heating control means, not shown. Accordingly, the silicon rubber roller 2 which is in contact with the rollers 1 and 3 is also indirectly heated and after all, the rollers 1, 2 and 3 plasticize by heat the toner 9 of the unfixed toner image on the recording medium 8 inserted into and passed through the nip 6 between the rollers 1 and 2 and cause the toner to be fused to the recording medium. Also, during the operation of the present apparatus, the roller 3 has a load applied thereto in the direction of the rollers 1 and 2 and thus, the nips 6 and 7 between the roller 1 and the roller 2 and between the roller 2 and the roller 3 assume surface contact state with the silicon rubber layer of the roller 2 pressure-deformed.

Application felt 10 is adapted to be suitably brought into contact with the surface of the roller 3 to apply a parting agent thereto. That is, the application felt 10 is lined with a back-up plate 11 which is fixed to a pivot shaft 12. The lower end of the application felt 10 is immersed in silicon oil 14 contained in an oil pan 13 so that the silicon oil 14 may permeate to the upper portion of the application felt 10 due to capillary phenomenon. The pivot shaft 12 is adapted to be reciprocally rotated in the directions of arrows by being suitably imparted a rotational force by an electrical signal resulting from image formation, and the back-up plate 11 is adapted to rotate with the pivot shaft 12 and urge the application felt 10 against the surface of the roller 3. By the application felt 10 being thus urged against the surface of the roller 3, the silicon oil 14 contained in the application felt 10 is applied to the surface of the roller 3 and this silicon oil is transferred to the roller 2 and the roller 1 in succession to prevent offset of the toner.

Description will now be made of a device for wiping off silicon oil adhering to the recording medium 8. A pair of conveyance guides 15 and 15' is disposed downstream of the pair of rollers 1 and 2 forming the nip 6 of the fixing station to guide the recording medium delivered from the fixing station into a wiping device lying downstream of the rollers 1 and 2 with respect to the direction of conveyance of the recording medium. The wiping device comprises a pair of wiping rollers 17 and 17', and a first pair of feeding rollers 16 and 16' and a second pair of feeding rollers 18 and 18' disposed upstream and downstream, respectively, of the wiping rollers 17 and 17' with respect to the direction of conveyance of the recording medium. The wiping rollers 17 and 17' have their surfaces covered with a parting liquid absorbing material suitable for absorbing the silicon oil 14 and wiping it off from the recording medium (such as, for example, unwoven fabric or Silbon paper). Driving means 19 transmits the drive force so that the rollers 1, 2, 16, 16', 17, 17', 18 and 18' may rotate in the forward direction with respect to the direction of movement of the recording medium. The wiping rollers 17 and 17' are displaceable to an acting position (shown position) in which they can apply a moderate contact pressure to the recording medium passing therebetween and a non-acting position in which they are not in contact with the recording medium. The acting position and the non-acting position may be brought about either by displacing the shafts of the rollers 17 and 17' by cams or levers which are conventional means or by displacing means 29 using a pluger or an electromagnetic solenoid as will later be described. The position changeover of the displacing means 29 may be accomplished by a signal S from special recording medium using means 28 produced by manually designating or automatically detecting a special recording medium. By the production of the signal S, the displacing means displaces the rollers 17 and 17' to the acting position, and when the signal S is not produced and by a special recording medium having substantially passed between the rollers 17 and 17', the displacing means displaces the rollers 17 and 17' to the non-acting position. The special recording medium refers to a recording medium inferior to ordinary paper in the capability of absorbing the parting liquid, i.e., silicon oil in the present example, and typically is film made of resin, and includes recording media subjected to surface treatment.

The first pair of feeding rollers and the second pair of feeding rollers are rotated at a predetermined speed equal to or slightly higher than the rotational speed of the fixing rollers 1 and 2, and the rotational speed of the wiping rollers 17 and 17' is determined by speed reduction means 26 so that it differs relatively from the conveyance speed of the recording medium so as to be convenient for wiping off the silicon oil on the recording medium.

Operation of the above-described apparatus will now be described.

When the present apparatus starts to operate, the rollers 1, 2 and 3 are driven and the heaters 4 and 5 are supplied with power to heat the rollers 1, 2 and 3. In image forming means 27, a latent image formed, for example, on a photosensitive medium is developed by toner 9 and transferred onto the recording medium 8. Immediately before the recording medium 8 carrying thereon the image by toner 9 enters the nip 6 between the rollers 1 and 2, a rotational force is imparted to the pivot shaft 12 by an electrical signal and the application felt 10 is urged against the roller 3 through the back-up plate 11. Thus, the silicon oil transmitted from the roller 3 to the surface of the roller 2 via the nip 7 arrives at the nip 6. At this time, the recording medium 8 is inserted into the nip 6 with the toner image 9 supported on the roller 2 side. At this nip 6, the toner image 9 is heated and fixed on the recording medium 8 and the silicon oil is supplied to the surface of the recording medium 8 and the surface of the toner image 9.

If the recording medium is ordinary paper, the silicon oil supplied and adhering to the recording medium substantially absorbed by the recording medium or dissipated during fixation. However, a recording medium such as a special recording medium which is low in silicon oil absorbing property hardly absorbs silicon oil or does not absorb silicon oil at all and therefore, particularly a great deal of silicon oil will adhere to the surface of the fixed image on the special recording medium. The parting agent removing means acts so as to be capable of coping with such problems.

Shift means 29 displaces the wiping rollers 17 and 17' to the acting position by the production of the signal S from the special recording medium using producing means 28 which corresponds to the fact that the toner image has been fixed on the special recording medium.

The special recording medium on which the toner image has been fixed passes between the guides 15 and 15', is subjected to the feeding force between the first pair of feeding rollers 16 and 16' and enters the nip between the wiping rollers 17 and 17'. Here, the resin film 8 as the special recording medium to the surface of which silicon oil has adhered is subjected to a suitable contact pressure by the wiping rollers 17 and 17', whereby the oil is removed. Since, in the present embodiment, the wiping rollers 17 and 17' are rotated at a peripheral speed different from the speed of movement of the film 8, the silicon oil on the film 8 is more efficiently wiped off due to the friction thereof with the liquid absorbing member on the wiping rollers 17 and 17'. As the peripheral speed of the wiping rollers 17 and 17' is higher, there is created a greater difference in speed relative to the speed of the film 8 and more effective wiping can be expected.

Thereafter, the film 8 is fed to the left as viewed in FIG. 1 by the second pair of feeding rollers 18 and 18' and is discharged onto a predetermined paper discharge tray 20, and the silicon oil on this discharged film becomes almost null.

Accordingly, where the recording medium on which the toner image is fixed is of a special material such as the aforementioned resin film which does not have the ability to absorb silicon oil (parting agent), the apparatus of the present invention acts effectively to efficiently eliminate the difficulties experienced in the prior art.

The wiping members on the wiping rollers 17 and 17' may be made interchangeable and in such case, the function of the present apparatus can be maintained semipermanently by the interchange of the wiping members. Also, in a mechanism wherein the conveying forces of the first feeding rollers 16, 16' and the second feeding rollers 18, 18' are made sufficiently greater than the friction force imparted to the film 8 by the wiping rollers 17 and 17', the direction of rotation of the wiping rollers 17 and 17' may be opposite to the direction of movement of the film and in such case, the conveyance itself of the film 8 is not affected but rather the speed of the wiping members relative to the speed of the film is enhanced and thus, an increased wiping effect can be expected. Also, the rollers 1 and 2 can be brought closer to the wiping rollers 17 and 17' to eliminate the guides 15, 15' and the first rollers 16, 16', thereby simplifying the mechanism. In FIG. 1, the image fixing station and the parting agent wiping device are disposed in proximity to each other, but these may be separate independent mechanisms and it will be understood that they may also be made into a form separate from the body of the image forming apparatus.

As another embodiment, the apparatus may use an endless belt type parting liquid absorbing member passed over the rollers and moved round, instead of one or both of the wiping rollers 17 and 17', or may use web-like member movable from the supply side to the take-up side. Particularly, the use of the web-like liquid absorbing member may achieve a stable parting agent removing effect because new web is provided so as to contact the special recording medium due to movement of the web.

Figure 2:
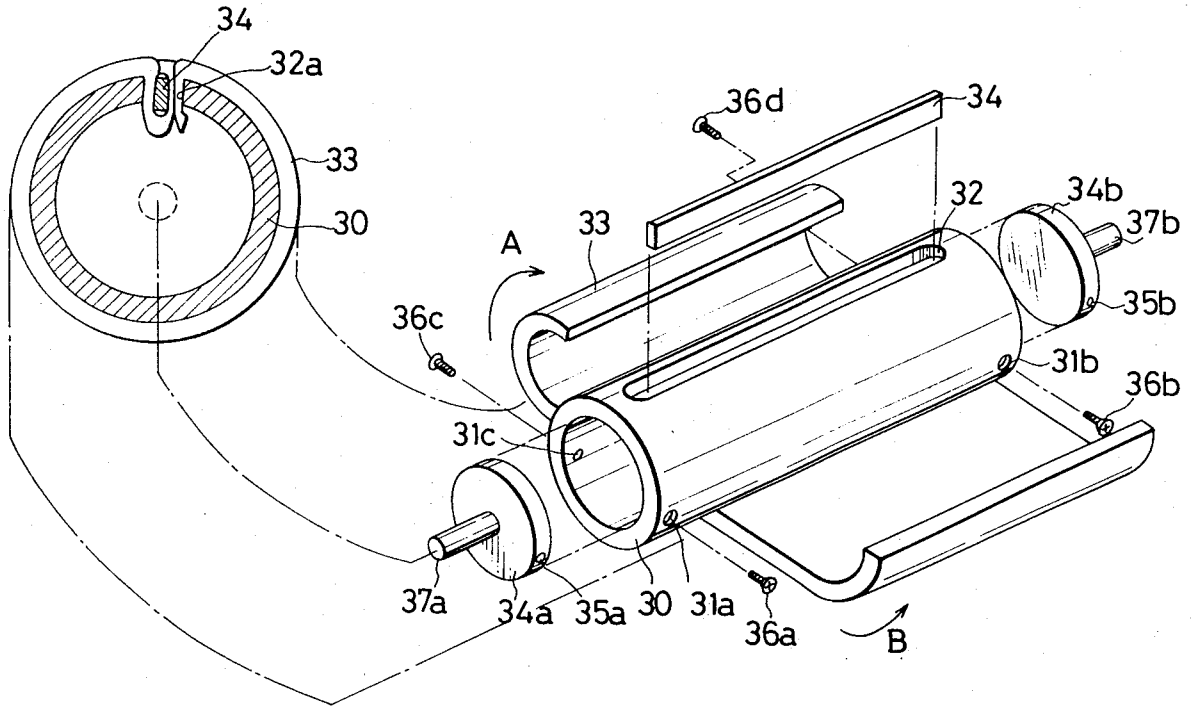
FIG. 2 is an enlarged view illustrating the wiping roller in the embodiment of FIG. 1.

FIG. 2 shows the construction of the rollers 17 and 17' of FIG. 1.

A mandrel 30 is of a hollow cylindrical shape and the opposite end portions thereof are provided with dish-shaped apertures 31*a*, 32*b*, 31*c* for counter-sunk screws and although not shown, a dish-shaped aperture opposed to the dish-shaped aperture 31*b*. The mandrel 30 has a slot-like opening 32 extending axially thereof. The length of this opening 32 is somewhat greater than the width of unwoven fabric 33 as a liquid absorbing member. A fixed plate 34 is of a size which is insertable into the opening 32. Flanges 34*a* and 34*b* can be fitted to the hollow portions at the opposite ends of the mandrel 30 and are provided with screw holes 35*a*, 35*b* and although not shown, screw holes opposed to the screw holes 35*a* and 35*b*, respectively. The positions of the dish-shaped apertures 31*a*, 31*b*, 31*c*, etc. in the opposite end portions of the mandrel 30 become coincident with the positions of the screw holes 35*a*, 35*b*, etc. in the flanges 34*a* and 34*b* when the flanges 34*a* and 34*b* are fitted to the mandrel 30, and the flanges 34*a* and 34*b* can be fixed to the mandrel 30 by means of counter-sunk screws 36*a*, 36*b*, 36*c* and 36*d*.

The unwoven fabric 33 is initially a rectangular sheet and the opposite ends thereof are bent in the directions of arrows A and B in FIG. 2 in the vicinity of the outer periphery of the mandrel 30, and the fabric 33 is deformed into a cylindrical shape so as to be along the outer periphery of the mandrel 30. One end portion of the unwoven fabric 33 is intactly inserted into the opening 32 of the mandrel 30. The other end portion of the unwoven fabric is once bent in the direction opposite to the mandrel 30 and the fixed plate 34 is nipped inside the bent portion. The fixed plate 34, with the unwoven fabric 33, is pushed or driven into the opening 32 and inserted into the opening 32. Thus, the unwoven fabric 33 is fixed to the mandrel 30 by the friction force between the fixed plate 34 and the unwoven fabric 33 and between the unwoven fabric 33 and the inner wall 32*a* of the opening 32 and is interchangeably held. Thereafter, the flanges 34*a* and 34*b* are fixed to the opposite ends of the mandrel 30 by counter-sunk screws 36*a*, 36*b*, 36*c* and 36*d* and are interchangeably incorporated into the parting agent wiping device.

The color recording apparatus of FIG. 3 permits the construction described in connection with FIG. 1 to be applied thereto, but may be explained as another embodiment.

An original supporting portion 39 comprising a transparent plate member such as a glass plate is provided on the top surface of the color copying apparatus 38 of FIG. 3, and below the original supporting portion 39, there are disposed an original illuminating light source 40 movable at a speed V in the direction of arrow and a first mirror $M_1$ for receiving the reflected light from an original.

Figure 3:
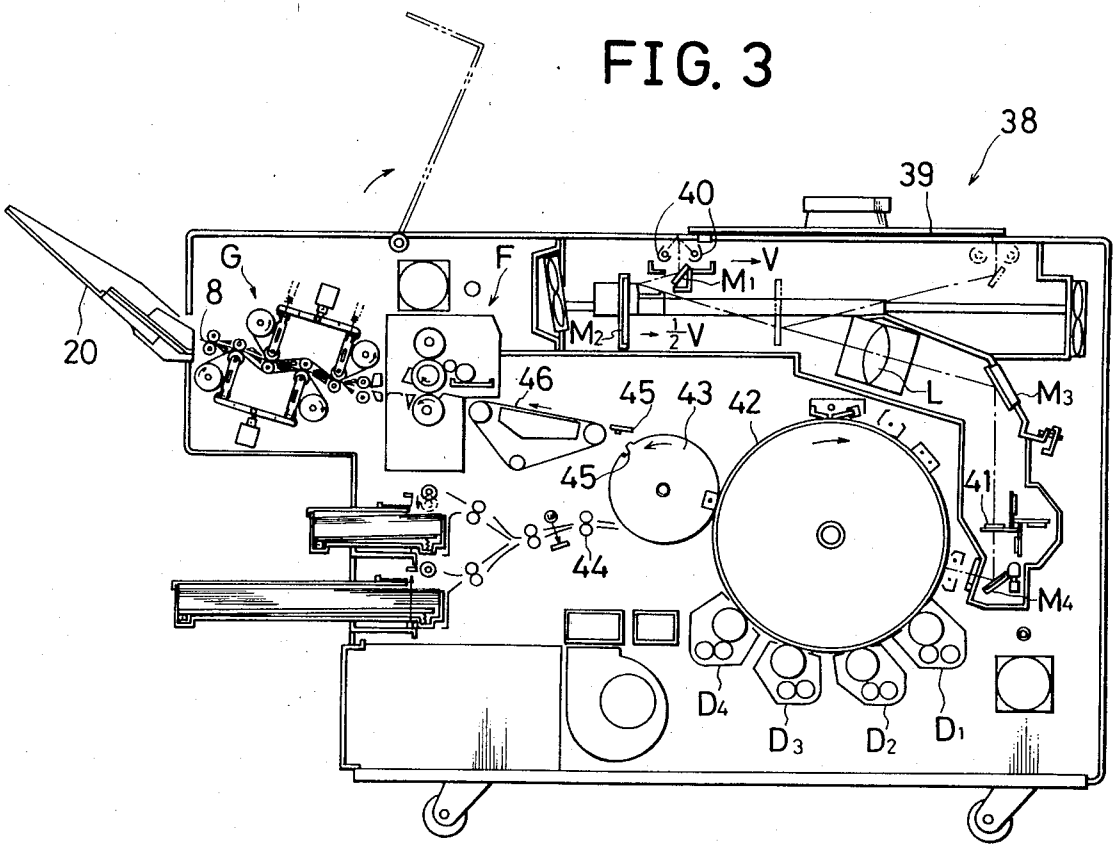
FIG. 3 illustrates a color recording apparatus according to an embodiment of the present invention.

The reflected light reflected by the first mirror $M_1$ arrives at a second mirror $M_2$ movable at a speed of $\frac{1}{2}$ V in the same direction as the first mirror $M_1$ and comes to a rotatable cylindrical photosensitive medium 42 via a lens system L, a third mirror $M_3$, a color resolving filter 41 and a fourth mirror $M_4$, as shown in FIG. 3, and forms a yellow image, a cyan image, a magenta image and a black image in succession on the surface of the photosensitive medium 42 correspondingly to the filter 41.

Disposed near the photosensitive medium 42 is a transfer drum 43 carrying a recording medium thereof and rotatable in synchronism with the photosensitive medium, and a recording medium taken out of a cassette comes to the transfer drum 43 via a path. At this time, the recording medium is wound and supported at a predetermined position on the surface of the transfer drum by register rollers 44 and recording medium gripping means 45 provided on the transfer drum and passes through a transfer position proximate to the photosensitive medium 42 with rotation of the transfer drum 43.

The color images formed on the surface of the photosensitive medium 42 through the color resolving filter 41 as previously described are successively visualized by developing devices $D_1$, $D_2$, $D_3$ and $D_4$ containing therein yellow, cyan, magenta and black dust toners and each of the visualized monochromatic or the multicolor image is transferred to the recording medium on the transfer drum 43 rotated in synchronism with the photosensitive medium.

The recording medium bearing thereon the color image or the monochromatic images is separated from the transfer drum 43 by a separating pawl, is conveyed by conveyor means 46 and comes to the aforementioned fixing device F, and the toners on the recording medium are melted, mixed and fixed in the fixing device F, and then the recording medium is discharged out of the copying apparatus.

In FIG. 3, there is shown a state in which parting liquid removing means G has acted on the resin film 8 after the color image has been fixed on the film 8. The details of the removing means G will hereinafter be described by reference to FIGS. 4 and 5.

Figure 4:
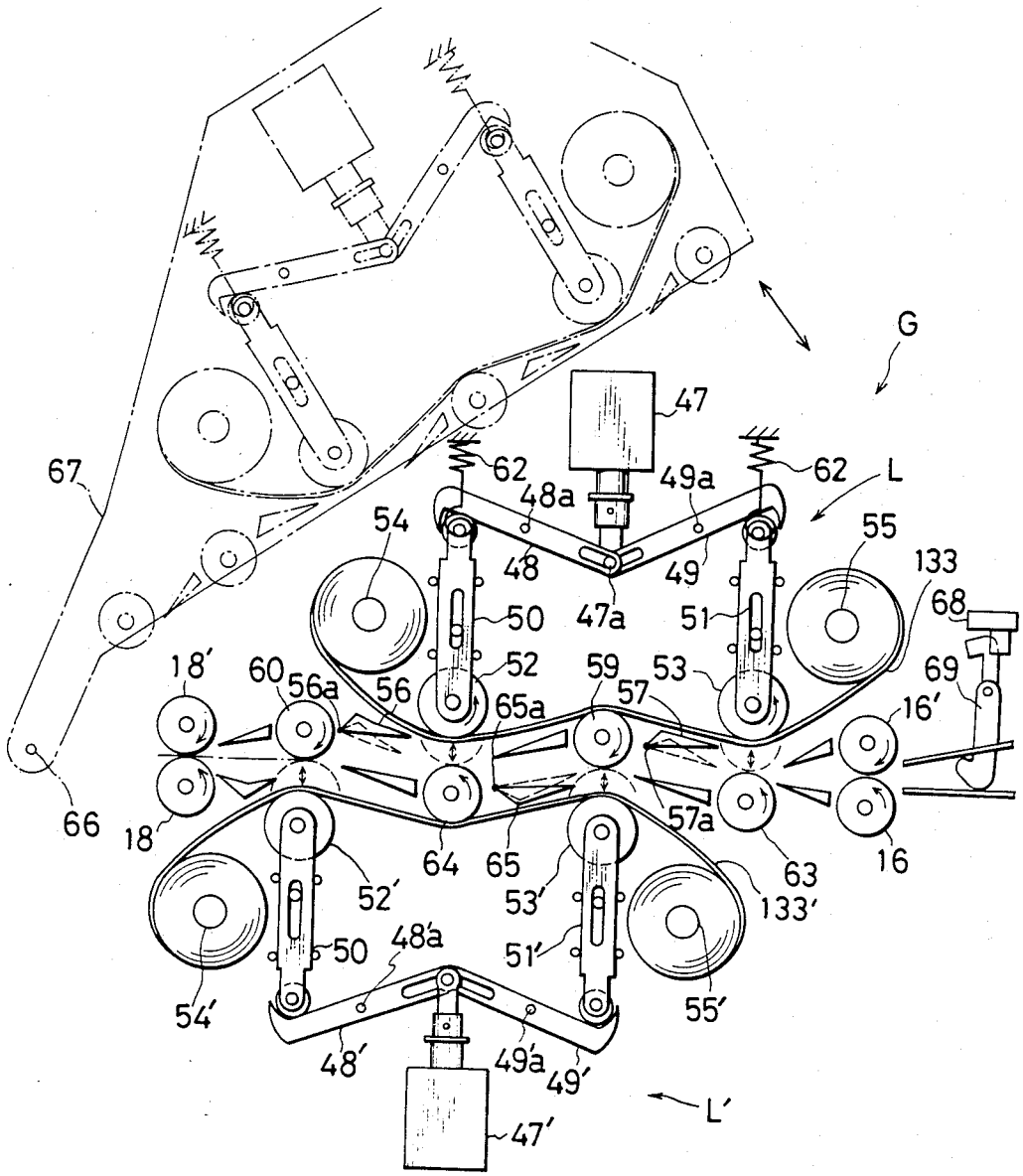
FIG. 4 illustrates the operation and construction of the parting agent removing means in the embodiment of FIG. 3.

As regards the removing means G of FIG. 4, a state in which oil absorbing webs 133 and 133' contacting the recording medium have been moved to the non-acting position relative to the recording medium is indicated by solid lines, and a state in which the webs are mounted or dismounted or spaced apart from each other during jam is indicated by phantom lines.

Within the solid lines of FIG. 4, an upper web removing device and a lower web removing device are substantially similar in construction to each other, and the upper device is positioned slightly upstream of the lower device with respect to the direction of conveyance of the recording medium.

The webs 133 and 133' are respectively passed over from web supply shafts 55 and 55' to web take-up shafts 54 and 54' and are supported in such a manner that they are moved between these shafts by rotatable pressing rollers, 53, 52, 53' and 52'. The rollers 53, 52; 53', 52' are provided with link mechanisms L and L' connected to the respective pairs of rollers, i.e., mechanisms having arms 48, 49 and 48', 49' moved at the acting point by electromagnetic plungers 47, 47' and pivotable with respect to respective fixed center points 48*a*, 49*a* and 48*a'*, 49*a'* and arms 50, 51 and 50', 51' supported on the arms 48, 49 and 48', 49', respectively by tension springs 62 or by gravity and vertically movable with the movement of said arms 48, 49 and 48', 49' and rotatably supporting rollers 53, 52 and 53', 52', and these mechanisms form means for displacing the webs to the acting position (dotted lines in FIG. 4) relative to the recording medium and the non-acting position (solid lines in FIG. 4).

A guide 57 between the rollers 53 and 59, a guide 65 between the rollers 59 and 64 and a guide 56 between the rollers 52 and 60 are moved to a web-acting position indicated by dotted lines and a web-non-acting position indicated by solid lines with respect to respective centers of pivotal movement 57*a*, 65*a* and 56*a* by springs, not shown, and cams or levers for varying the spring forces. These guides 56, 57 and 65 normally guide the recording medium.

Plungers 47 and 47' are operated by control means, not shown (such as a timer or operation control means for detecting the discharge of the recording medium) to hold the webs 133 and 133' in the acting position until the special recording medium passes through the removing means G when the aforementioned signal S and the signal T by means comprising a conventional photointerrupter 68 for detecting the arrival of the leading end edge of the recording medium after subjected to the fixing process at the removing means G and a pivotable lever 69 are both input. The movement stopping control of the webs 133 and 133' at this time may be effected as described in connection with the previous embodiment, but the drive for moving the webs is provided by rotation of take-up shafts 54 and 54'.

Causing a support plate 67 pivotable about a shaft 66 on the paper discharge side as indicated by phantom line in FIG. 4 to hold at least the upper web removing device can facilitate the treatment during jam or the interchange of the webs. In the present embodiment, the support plate 67 is caused to hold all of the groups of conveyance guides and conveyor rollers 16', 59, 60 and 18' also and thereby opens the path of the recording medium and therefore, the treatment during jam becomes easier.

Figure 5:
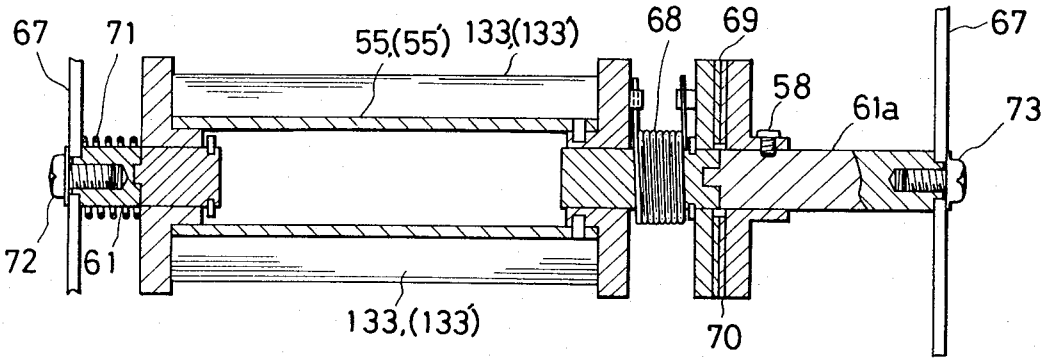
FIG. 5 illustrates the construction of the web supplying roller of FIG. 4.

Also, if the webs 133 and 133' are made displaceable, slack may be created in the webs to hamper the conveyance of the recording medium and therefore, it is preferable to provide the take-up shaft 54 and 54' or the supply shaft 55 and 55' with means for absorbing the slack of the webs. FIG. 5 shows an example of such means. The supply shafts 55 and 55' rotated under the pull force from the take-up shafts 54 and 54' have a web slack preventing mechanism comprising a clutch plate 70 on the immovable side which is in frictional engagement with a predetermined pressure contact force and a clutch plate 69 rotatable with the shafts 55 and 55', and a torsion coil 68 connecting the clutch plate 69 to the shafts 55 and 55'. When a force exceeding the friction force between the clutch plates 69 and 70 acts due to the pull force, the shafts 55 and 55' are rotated and a spring force for rotating the shafts 55 and 55' in the reverse direction is stored in the torsion coil 68. When the webs assume the non-acting position, the webs become slack, but any excess portion of the webs is taken up on the supply shaft side by the force of the torsion coil 68. Designated by 71 is a pressure spring provided between the support plate 67 as a side plate and the shafts 55, 55' to provide the pressure contact force between the clutch plates 70 and 69. The clutch plate 70 is fixed to a support shaft 61*a* by a screw 58. Reference numerals 72 and 73 designate screws for fixing to plates 67 the support shafts 61 and 61*a* each having an uneven portion and being in friction engagement with the shafts 55 and 55'.

FIGS. 6 to 12 show an embodiment having means for imparting an auxiliary agent for reducing the adhesion of the parting liquid to the special recording medium, as the parting liquid removing means of the present invention.

Figure 6:
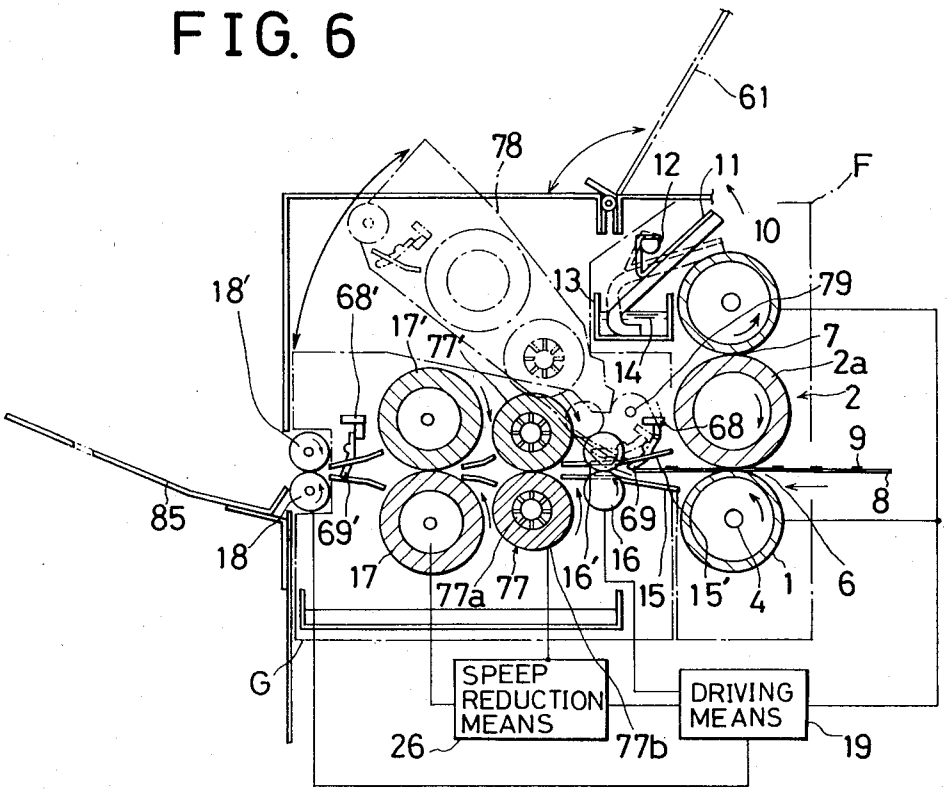
FIG. 6 illustrates another embodiment of the present invention.

FIG. 6 shows an embodiment in which the following additional construction is added to the embodiment of FIG. 1.

The rear side of the conveyance path of carry-in guides 15' and 15 is cut away in the form of comb teeth and the aforementioned conveyor rollers 16 and 16' are disposed in the cut-away concave portions. A recording medium passage detecting lever 69 pivotable about a shaft fixed to the body is disposed between the conveyor rollers 16, 16' and the fixing station F. The lower portion of the lever 69 faces the conveyance path from the cut-away of the carry-in guide 15' due to gravity. When a recording medium arrives at between the carry-in guides 15 and 15' and the immediate front of the conveyor rollers 16 and 16', the lower side of the lever 69 is pushed up by the leading end edge of the recording medium and the lever 69 is rotated clockwise. At this time, the light-emitting portion and the light-receiving portion of the photointerrupter 68 disposed above the lever 69 lie on the path of pivotal movement of the upper end of the lever 69 and therefore, the upper end of the lever 69 intercepts the light emitted from the photointerrupter 68. By using this change, the lever 69 and the photointerrupter 68 effect the detection of the passage of the recording medium and produce the detection signal S. A pair of washing agent applying rollers 77 and 77' is disposed between the conveyor rollers 16, 16' and the aforementioned pair of wiping rollers 17, 17'. Each of the washing agent applying rollers 77 and 77' comprises a hollow mandrel covered with a porous material *77b* such as foamed resin or foamed rubber. The hollow portion of the mandrel of each of the rollers 77 and 77' is formed by a porous roller *77a* in which is enclosed a substance such as alcohol which decomposes and melts or facilitates the dispersion of the parting agent such as silicon oil. The porous roller *77a* has a plurality of through-holes in the boundary covered with the porous material *77b* so that the washing agent in the hollow portion permeates into the porous material *77b*. Accordingly, if the rollers 77 and 77' are moved to the acting position when the special recording medium passes between these rollers, the washing agent can be applied to the both sides of the recording medium to facilitate the removal of the parting agent from the recording medium. Although the speed of the rollers 77 and 77' may be equal to the conveyance speed of the recording medium, it is preferable that the speed of the rollers 77 and 77' be different from the conveyance speed of the recording medium in order to provide an acting force for removing the parting agent and facilitate the mixing of the parting agent with the washing agent.

In the embodiment of FIG. 6, the speed of the washing agent containing type applying rollers 77 and 77' is made equal to the speed of the wiping rollers 17 and 17' and lower than the conveyance speed of the recording medium. A lever 69' and a photointerrupter 68' for detecting the passage of the recording medium through the liquid removing means are provided between the rollers 17, 17' and the rollers 18, 18' and upon detection of the passage (in the case of continuous fixation, the passage of the last recording medium), the photointerrupter 68' produces a signal T' for instructing the rollers 17', 17 and the rollers 77, 77' to be spaced apart to their respective non-acting positions. This spacing apart and movement of the rollers to the acting position is accomplished by displacing means 29' shown in FIG. 7.

The movement of the rollers 17', 17 and the movement of the rollers 77, 77' are effected in synchronism with each other by the same mechanism and therefore, the movement of the rollers 17, 17' will be readily understood by describing the applying rollers 77, 77' chiefly.

Support shafts 88 and 84 are fixed to the body of the parting agent wiping device G, and arms 76, 82 and arms 58, 83 are supported for pivotal movement about these support shafts, respectively. Bearings are fitted to the coupling portion between one end of the arms 76, 82 and arms 58, 83 and the roller shaft, and the applying rollers are rotatably supported by these bearings. One end of each of arms 74, 86 and arms 75, 87 is likewise fitted to a bearing, and the arms 74, 86 and arms 75, 87 are rotatable. The other ends of the arms 74, 86 and arms 75, 87 overlap each other, and plungers 80 and 81 are coupled thereto. Tension springs 89 and 85 are secured to the other ends of the arms 76, 82 and arms 58, 83 which are opposite to the bearings with respect to the support shafts 88 and 84 to cause biasing forces for reducing the spacings between these arms to act on the arms. Accordingly, the spacings on the bearing side between the arms 76, 82 and the arms 58, 83 are normally widened by the tension springs 89 and 85 and therefore, the washing agent applying rollers 77 and 77' are spaced apart from each other.

The plungers 80 and 81 are operated by control means, not shown, by the signal S produced by the special recording medium and the signal T corresponding to the detection of the approach of the recording medium being both input thereto and attract the arms 74, 75 and the arms 86, 87, thereby moving the rollers 77', 77 and the rollers 17', 17 to the acting position in which they are urged against the special recording medium. Specifically, the pair of rollers 77', 77 and the pair of rollers 17', 17 may be brought into contact with each other. Also, the plungers 80 and 81 are deenergized by a signal T' produced upon detection of the passage of the recording medium and cause the rollers to be spaced apart from each other by the springs 89 and 85.

Figure 7:
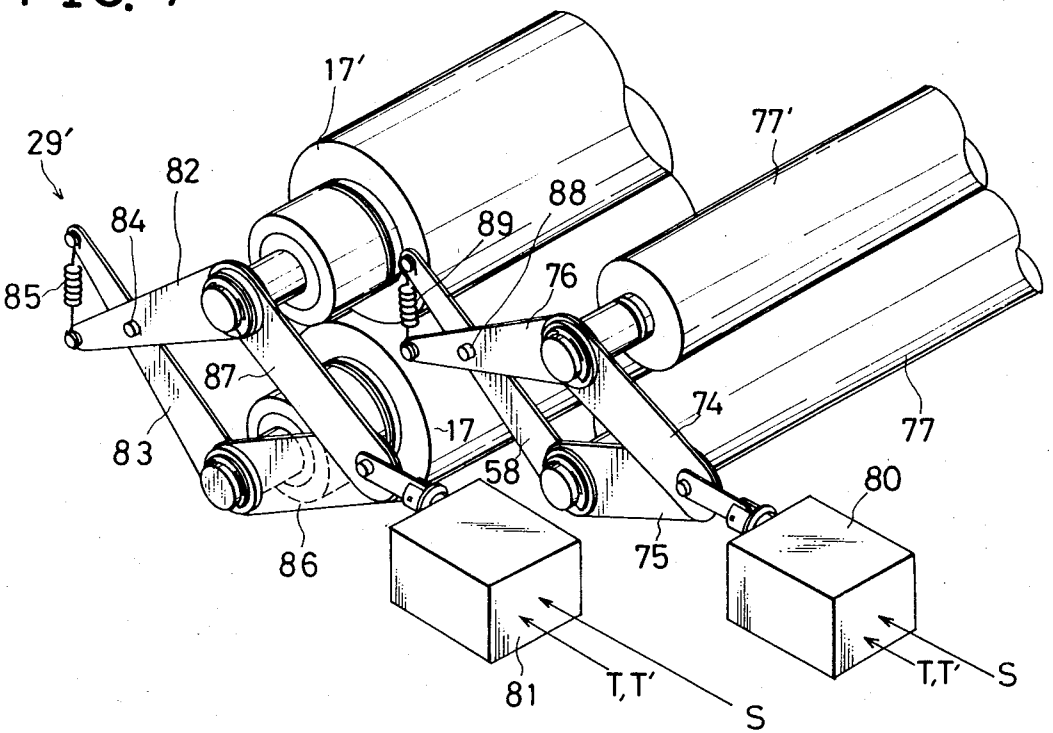
FIG. 7 illustrates an operation control mechanism which is an essential portion of the embodiment of FIG. 6.

FIG. 7 briefly shows the end on this side, and the other end may also be arranged in a similar manner.

As described above, there is provided imparting means for imparting an alcoholic component containing agent, a washing agent and an auxiliary agent such as an interface activator to the parting liquid on the special recording medium to weaken the adhesion of the parting liquid or decompose the parting liquid and thereby substantially enhance the removal efficiency of the parting liquid and therefore, the parting liquid cleaning effect of the wiping means can be enhanced. In this case, the wiping means may preferably be one which removes the auxiliary agent and the parting agent and the mixed product thereof from the recording medium, and more particularly may be the liquid absorbing member as described in connection with FIG. 1.

FIGS. 8 to 11 show only an auxiliary agent supply device which is used in the manner as described in connection with FIG. 6. The features of this device are the example of FIGS. 10 and 11 in which the auxiliary agent supply member is interchangeable and the example of FIGS. 8 and 9 in which the construction for supplying the auxiliary agent to the supply member is interchangeable.

Figure 8:
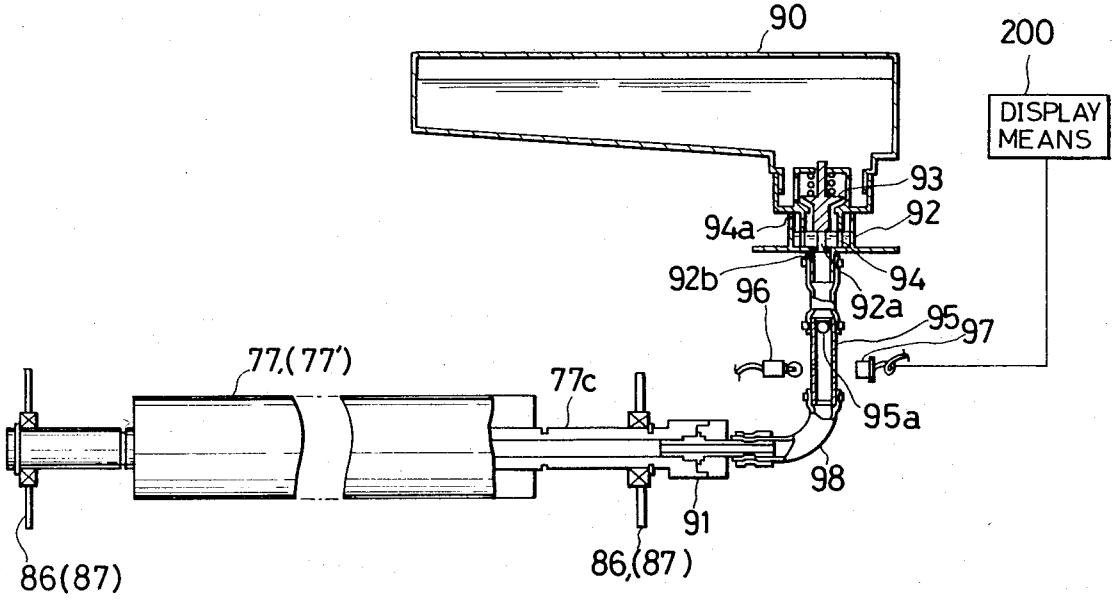
FIGS. 8 to 10 and 12 illustrate various embodiments of the auxiliary agent supply device of the present invention.

FIG. 8 shows an example which uses the chicken feed method from a supply cartridge 90 as the means for replenishing the auxiliary agent consumed from the interior of the porous roller 77*a* of the aforementioned applying roller 77 (77'). The supply cartridge 90 is provided with a valve 93 whose supply port is adapted to be closed by a spring, is filled with the auxiliary agent and is interchangeable. A body fixing portion 92 on which the cartridge 90 is mounted is of a double cylinder type and has an opening 94 in the lower portion of the inner cylinder and an opening 94*a* in the uppermost portion of the outer cylinder, the opening 94 being positioned downstream of the opening 94*a* with respect to the direction of gravity and being spaced apart from the opening 94*a*. The opening 94*a* is an air hole constructed so as to enable the opening 94 to automatically effect the supply of the auxiliary agent. When the opening 94 becomes open, the auxiliary agent is supplied and, when the opening 94 is covered up tight with the auxiliary agent, movement of the auxiliary agent is stopped. The projection 92*a* of the body fixing portion 92 raises the valve 93 of the cartridge 90 and always opens the supply port of the cartridge 90. An opening 92*b* is provided at the root of the projection 92*a* and the auxiliary agent flows down through this opening 92*b*. Designated by 98 is a flexible tube 98 constituting a supply path leading from the fixing portion 92 to the auxiliary agent path 77*c* of the roller 77. The flexible tube 98 has in the intermediate portion thereof a float mechanism 95 having a light source 96, a light sensor 97 and a float ball 95*a* as means for detecting the remaining quantity of the auxiliary agent. The float ball 95*a* is normally positioned upwardly, but when the auxiliary agent is exhausted in the cartridge 90, the float ball 95*a* falls and crosses the space between the light source 96 and the light sensor 97. Thus, there is provided a display or warning sound which informs the operator of the necessity of interchanging the cartridge 90 (not shown). Accordingly, the parting liquid removing effect can be stabilized to enable the cartridge 90 to be interchanged while the auxiliary agent is present in the rollers 77 and 77'. Designated by 91 is a connecting portion between the tube 98 and the path 77*c*. The flexible tube 98 can sufficiently cope with the movement of the rollers 77 and 77'.

Figure 9:
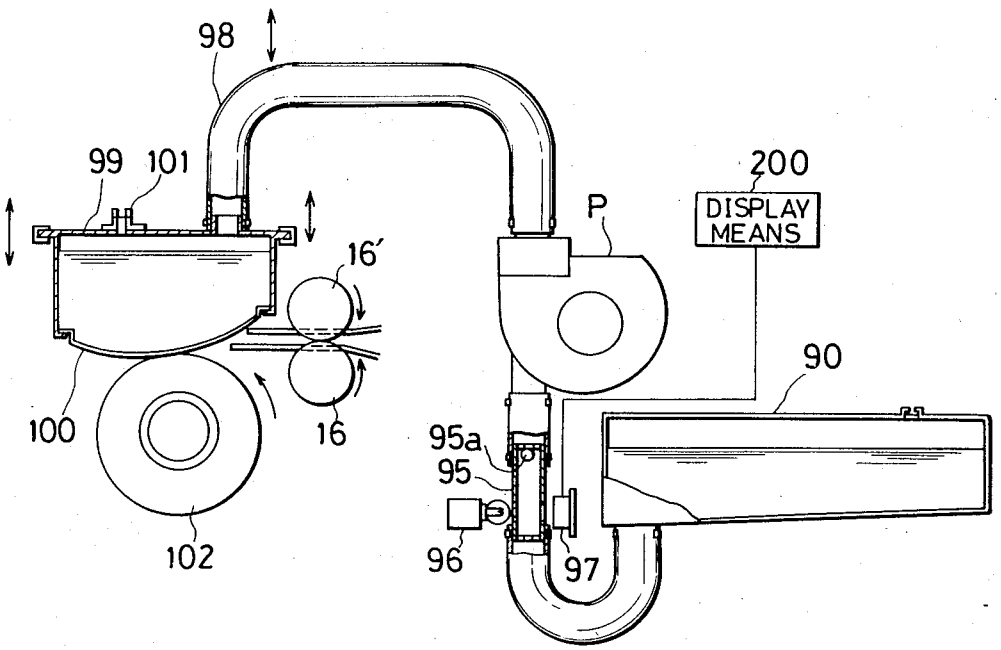

FIG. 9 shows an example in which the auxiliary agent is supplied by a pump P unlike the example of FIG. 8 in which the auxiliary agent is supplied by utilization of gravity. In this example, a directly applying type porous film 100 and a conveyor roller 102 are used instead of the applying rollers 77 and 77' of FIG. 6. The applying means has in the lower portion thereof a liquid container 99 connected to the flexible tube 98 from the pump P and a porous film (POREFLON; trade name, a product of Sumitomo Denko Co., Ltd., or GORE-TEX; trade name) 100 passing therethrough a slight amount of auxiliary liquid. A slight amount of auxiliary agent oozes out on the surface of this film and can therefore be applied to the surface of the special recording medium. The surface of a roller 102 positioned below the film 100 bears against the film 100 and therefore, a slight amount of auxiliary agent is applied also to the surface of this roller. Thus, the auxiliary agent can be supplied also to the back side of the recording medium. The other constructions are as described in connection with FIG. 8.

Figure 11:
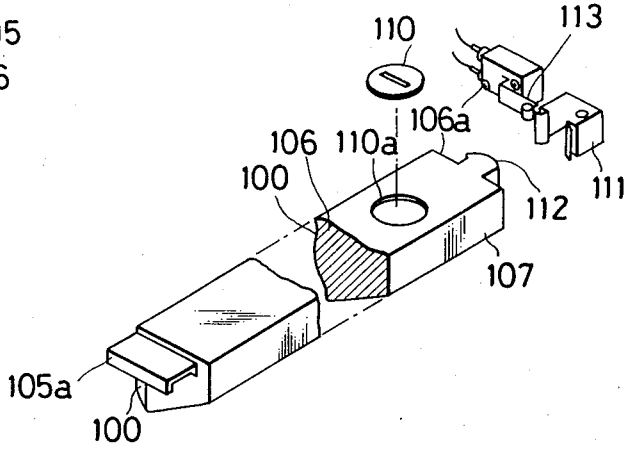
FIG. 11 illustrates an interchangeable auxiliary agent supply member in the embodiment of FIG. 10.
Figure 10:
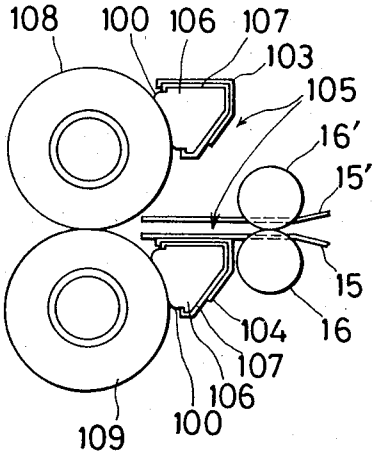

FIG. 10 shows an embodiment for supplying the washing agent from the outside of washing agent applying rollers 108 and 109. In this case, the washing agent applying roolers 108 and 109 need not hold the washing agent therewith, and a rubber-like elastic material having a moderate degree of wetness of the roller surfaces and having a hardness which readily permits compression and deformation of the portions of the rollers which are in contact with each other is suitable for the rollers 108 and 109. Guide rails 103 and 104 are fixed to the body of the parting agent wiping device G, and a washing agent supply device 105 is inserted into these guide rails 103 and 104 axially of the washing agent applying rollers from outside the device and is fixed. The washing agent supply device 105 comprises an outer frame 107, a washing agent holding member 106, the aforementioned porous film 100 and the washing agent contained in the washing agent holding member 106. FIG. 11 shows an example of the washing agent supply device. There is provided a handle 105*a* on this side of the outer frame 107 of the washing agent supply device 105 with respect to the direction of insertion so as to provide a better operability when the washing agent supply device is to be put in and out. On the other hand, a projection 112 extending axially is provided on the inner side of the outer frame 107. The width of the root of the projection 112 is smaller than the maximum width of the forward portion of the projection 112. On the inner side of the guide rails 103 and 104, there is provided a grip member 111 fixed to the device G and formed of a spring plate material. The projection 112 bears against the bend of the grip 111 and is further inserted and fitted thereinto, and the washing agent supply device 105 is gripped and fixed in place.

Means 113 for detecting whether the device 105 is mounted on the grip member 111 is provided adjacent to the grip member 111 and application of the washing agent can be reliably accomplished by this means 113. Reference numeral 110 designates a lid of the washing agent supply port 110*a*, but alternatively, the aforementioned supply means may be mounted in the supply port 110*a*.

The aforementioned movement to the acting position by the special recording medium may preferably be applied to FIGS. 8 to 10.

Figure 12:
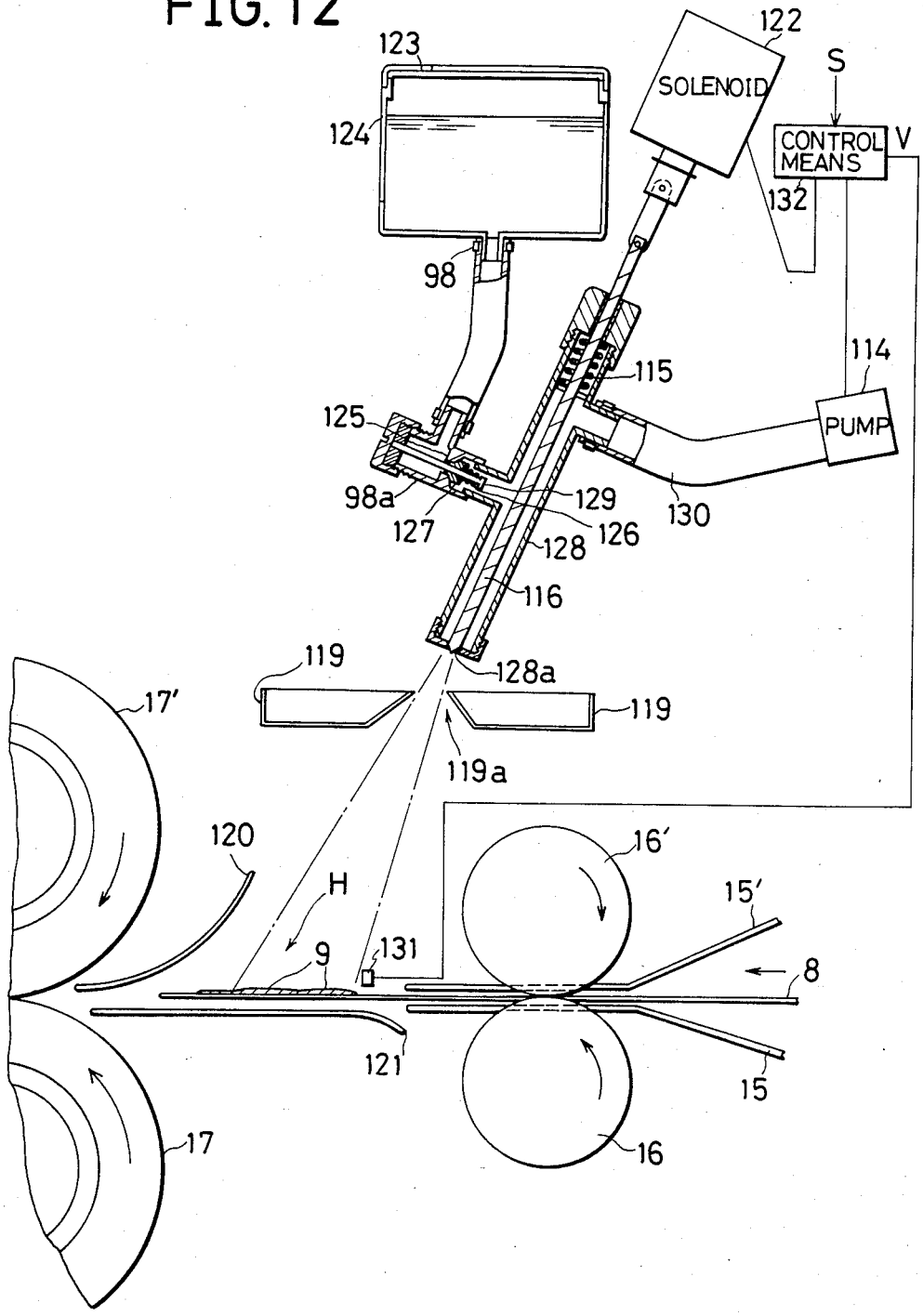

FIG. 12 shows a device for imparting the auxiliary agent such as washing agent by a spray system. A spray area H formed by an upwardly bent guide 120 and a pair of garters 119 is formed between the aforementioned pair of wiping rollers 17, 17' and the feeding rollers 16', 16. A recording medium detecting sensor 131 is provided at the entracne of the spray area H and the detection signal U thereof is supplied to control means 132. The control means 132 effects the operation of a solenoid 122 for opening a spray port 128*a* as the nozzle of the spray device and a pump 114 for supplying high-pressure air for spray by the signal S of the aforementioned special recording medium and the signal U being input to the control means.

After the air from the pump 114 has been supplied, washing liquid is supplied by an opening-closing valve 127 and a spray tube 128 injects the mixture of the air and the washing liquid from the spray port 128*a*. The spray port 128*a* is normally closed by a needle 116 having a tapered end being pressed by a compression spring 115, and is opened when the needle 116 is pulled by the action of a solenoid 122 and discharges the high-pressure air supplied via the pump 114 and a connecting pipe 130. An axial high-speed air stream is produced in the spray tube 128 and the atmospheric pressure in the portion of the tube 128 which is adjacent to the valve 127 falls due to the Bernoulli's theorem. Thus, the valve 127 normally closing the washing liquid supply port 125 of the tube 98*a* by a compression spring 126 is moved toward the tube 128 in which the high-speed air stream is being produced, against the force of the compression spring 126. Consequently, the supply port 125 is opened and the washing liquid is supplied into the tube 128, is atomized by the high-speed air stream and is applied to the special recording medium. When the recording medium passes through the area H, the signal from the sensor 131 disappears and therefore, the control means stops the operation of the solenoid 122 and of the pump 114. Thus, the needle 116 and the valve 127 close their respective openings along a shaft 129 by the compression springs 115 and 126, respectively.

Although not shown, the flexible tube 98 is provided with the remaining amount detecting means shown in FIGS. 8 and 9. The garters 119 control the area through which the spray passes, by an opening 119*a*, and also collect any excess liquid. Also, the pressure in the tube is maintained high by a pump or other means to prevent the liquid leakage when the device is not used.

While various embodiments of the present invention have been described above, the present invention covers not only all of these arbitrary combinations but also all of the embodiments based on the technical idea of the present invention.

According to the present invention, the parting agent which has adhered to the special recording medium in the image fixing step of the image forming apparatus can be efficiently wiped off, whereby the sense of displeasure experienced when the special recording medium is touched by the hand after the fixation is eliminated and anything which contacts the special recording medium is not stained and in addition, even if special recording mediums having passed through the parting agent removing means are superposed one upon the other, the absorbing action by the parting agent does not occur and therefore the special recording mediums can be handled easily and further, magic ink or the ink of felt pens can be put on the recording medium and therefore, writing of characters or the like on the recording medium becomes possible.

What I claim is:

1. A recording apparatus having:

means for forming a toner image;

fixing means for fixing the formed toner image on a recording medium, said fixing means having a fixing rotatable member for contacting the toner image side of the recording medium and means for applying offset preventing parting liquid to said fixing rotatable member;

means for acting on a special recording medium inferior in parting liquid absorbing capability to paper and removing the parting liquid from the special recording medium, said removing means being positioned downstream of said fixing rotatable member with respect to the direction of conveyance of the recording medium;

means for rotating said fixing rotatable member; and control means for causing said removing means to act on said special recording medium.

2. A recording apparatus according to claim 1, wherein said removing means has a wiping member for contacting the special recording medium and absorbing the parting liquid, and means capable of moving the portion of said wiping member which absorbs the parting liquid from the special recording medium.

3. A recording apparatus according to claim 2, wherein said moving means has speed changing means for making the movement speed of said wiping member different from the speed at which the special recording medium is conveyed, and said wiping member bears against the special recording medium with a relative speed difference with the aid of said speed changing means.

4. A recording apparatus according to claim 3, wherein said wiping member is a roller, an endless belt or a web.

5. A recording apparatus according to claim 1, wherein said control means has means for producing a signal corresponding to the fact that the recording medium having the toner image fixed thereon is a special recording medium, and means responsive to the signal from said signal producing means to displace said removing means from a non-acting position relative to the recording medium to an acting position.

6. A recording apparatus according to claim 5, wherein said removing means has a wiping member for contacting the special recording medium and absorbing the parting liquid, and means capable of moving the portion of said wiping member which absorbs the parting liquid from the special recording medium, and said displacing means displaces said wiping member.

7. A recording apparatus according to claim 6, wherein said moving means has speed changing means for making the movement speed of said wiping member different from the speed at which the special recording medium is conveyed, and said wiping member bears against the special recording medium with a relative speed difference with the aid of said speed changing means.

8. A recording apparatus according to claim 7, wherein said wiping member is a roller, an endless belt or a web.

9. A recording apparatus according to claim 1, wherein said removing means has a parting liquid absorbing wiping member interchangeably with respect to the body of said apparatus, said wiping member being caused to bear against the special recording medium by said control means.

10. A recording apparatus according to claim 1, wherein said removing means has a pair of wiping members adapted to bear against the front and back surfaces, respectively, of the special recording medium, said pair of wiping members having a parting liquid absorbing surface.

11. A recording apparatus according to claim 1, wherein said toner image forming means is capable of forming a color toner image, said special recording medium is a resin film, and said control means causes said removing means to act on the resin film when the color toner image has been fixed on the resin film.

12. A recording apparatus having:

means for forming a toner image;

fixing means for fixing the formed toner image on a recording medium, said fixing means having a fixing rotatable member for contacting the toner image side of the recording medium, and means for applying offset preventing parting liquid to said fixing rotatable member;

means for acting on a special recording medium inferior in parting liquid absorbing capability to paper and removing the parting liquid from the special recording medium, said removing means being positioned downstream of said fixing rotatable member with respect to the direction of conveyance of the recording medium, said removing means having means for imparting to the special recording medium an auxiliary agent for reducing the adhesion of the parting liquid to the special recording medium, and wiping means for bearing against the special recording medium to which the auxiliary agent has been imparted by said imparting means and wiping off the parting liquid and the auxiliary agent on the special recording medium;

means for rotating said fixing rotatable member; and control means for causing said removing means to act on said special recording medium.

13. A recording apparatus according to claim 12, wherein said parting agent is silicon oil and said auxiliary agent is a liquid containing an alcoholic component or an interface activator.

14. A recording apparatus according to claim 12, wherein said imparting means has an interchangeable member holding the auxiliary agent therein so as to be capable of supplying the auxiliary agent, and said wiping means has an interchangeable parting liquid absorbing member.

15. A recording apparatus according to claim 12, wherein said imparting means has a member for temporarily holding the auxiliary agent to supply the auxiliary agent to the special recording medium, and supply means for supplying the auxiliary agent to said holding member and storing the auxiliary agent therein.

16. A recording apparatus according to claim 15, wherein said imparting means has means for detecting the remaining amount of the auxiliary agent stroed in said supply means, and means for displaying the result of the detection by said detecting means.

17. A recording apparatus according to claim 12, wherein said control means has means for producing a signal corresponding to the fact that the recording medium having the toner image fixed thereon is a special recording medium, and means responsive to the signal from said signal producing means to displace both said imparting means and said wiping means to a non-acting position relative to the recording medium and an acting position.

18. A recording apparatus according to claim 12, wherein said toner image forming means is capable of forming a color toner image, said special recording medium is a resin film, and said control means causes said imparting means and said wiping means of said removing means to act on said resin film when the color toner image has been fixed on said resin film.

19. A recording apparatus according to claim 18, wherein said parting agent is silicon oil and said auxiliary agent is liquid containing an alcoholic component.

20. A recording apparatus according to claim 12, wherein said imparting means has a minutely porous member capable of oozing out the liquid auxiliary agent while holding the liquid auxiliary agent.

* * * * *

UNITED STATES PATENT AND TRADEMARK OFFICE

CERTIFICATE OF CORRECTION

PATENT NO. : 4,541,707

DATED : September 17, 1985

INVENTOR(S) : KENJI YOSHINAGA

It is certified that error appears in the above-identified patent and that said Letters Patent is hereby corrected as shown below:

Column 2, line 42, insert --a-- after "has".

Column 4, line 65, insert --is-- after "medium".

Column 12, line 2, "roolers" should read --rollers--;
line 50, "entracne" should read --entrance--.

Column 16, line 5, Claim 16, "stroed" should read --stored--.

Signed and Sealed this

*Fifteenth* Day of *July 1986*

[SEAL]

*Attest:*

DONALD J. QUIGG

*Attesting Officer*

*Commissioner of Patents and Trademarks*